US006981625B2

(12) United States Patent
Schad

(10) Patent No.: US 6,981,625 B2
(45) Date of Patent: Jan. 3, 2006

(54) PERCUSSIVE ELECTRICAL HAND-HELD POWER TOOL

(75) Inventor: Hanspeter Schad, Grabs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/761,545

(22) Filed: Jan. 20, 2004

(65) Prior Publication Data

US 2004/0206521 A1 Oct. 21, 2004

(30) Foreign Application Priority Data

Jan. 17, 2003 (DE) ..... 103 02 089

(51) Int. Cl.
*B25C 1/08* (2006.01)

(52) U.S. Cl. ..... 227/9; 173/109; 173/201

(58) Field of Classification Search ..... 227/9; 173/201, 109

See application file for complete search history.

(56) References Cited

U.S. PATENT DOCUMENTS

| | | | | |
|---|---|---|---|---|
| 2,815,430 A | * | 12/1957 | Weiss | 228/18 |
| 3,184,353 A | * | 5/1965 | Lewis et al. | 156/73.1 |
| 3,283,182 A | * | 11/1966 | Byron et al. | 310/325 |
| 3,431,593 A | * | 3/1969 | Miller | 425/110 |
| 3,511,323 A | * | 5/1970 | Riley, Jr. | 173/117 |
| 3,581,832 A | * | 6/1971 | Heermann et al. | 173/162.2 |
| 3,681,627 A | | 8/1972 | Murry et al. | |
| 3,727,700 A | * | 4/1973 | Amtsberg | 173/18 |
| 3,733,700 A | * | 5/1973 | Notaras et al. | 30/381 |
| 4,669,553 A | * | 6/1987 | Hukase | 173/127 |
| 6,286,610 B1 | * | 9/2001 | Berger et al. | 173/162.1 |
| 6,484,814 B2 | * | 11/2002 | Bongers-Ambrosius | 173/2 |
| 6,776,245 B2 | * | 8/2004 | Kristen et al. | 173/217 |
| 6,843,327 B2 | * | 1/2005 | Meixner et al. | 173/11 |

FOREIGN PATENT DOCUMENTS

| | | |
|---|---|---|
| DE | 19830415 | 7/1998 |
| DE | 10130088 | 6/2001 |

* cited by examiner

*Primary Examiner*—Louis K. Huynh
*Assistant Examiner*—Brian Nash
(74) *Attorney, Agent, or Firm*—Abelman, Frayne & Schwab

(57) ABSTRACT

An electrical hand-held power tool for at least partially percussive driving of a tool (1) along a striking axis (A) and including a striking mechanism (2) having a striker (3) for generating striking forces on the anterior arranged tool (1) and a housing (5) enclosing the striking mechanism (2) and having a handle (6) affixed thereto, with the striker (3) being formed as a high-energy piezo actor connected with a voltage pulse generating unit (7), and rearwardly affixed to the housing (5).

9 Claims, 2 Drawing Sheets

PERCUSSIVE ELECTRICAL HAND-HELD POWER TOOL

BACKGROUND OF THE INVENTION

1. Field of the Invention

Figure 1:
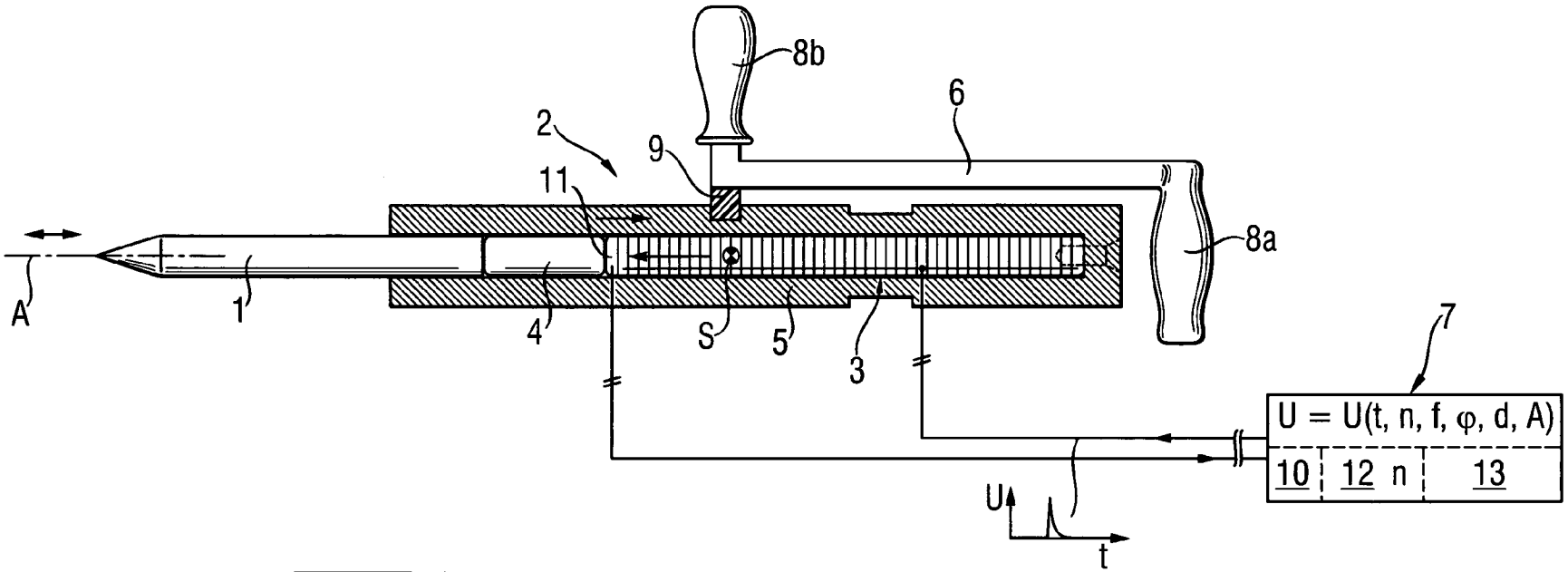

The invention relates to an at least partially percussive electrical hand-held power tool, in particular a chisel hammer or a pin hammer.

2. Description of the Prior Art

Usually the striking mechanism of percussive electrical hand-held power tools with a rear hand handle are formed as pneumatic striking mechanisms having a percussion piston movable at least in part along the length of a guide cylinder and which is actuated by a pneumatic spring which, in turn, is guided by an actuation means driven by an electrical motor. The plurality of mechanically actuated components for driving the striking means that actually apply an impact force on front end of the tool or on an anvil situated therebetween, substantially increases the passive mass of an electrical hand-held power tool.

According to U.S. Pat. No. 1,966,446, the striking mechanism in an electrical hand-held power tool is configured as an axially resonant vibrating rod oscillator, which is mounted in the middle on a vibration nodal point and is excited to vibrations of about 16 KHz using a piezo element supplied with an a.c. current. Such a configuration results, even with excitation in the ultrasound range in a necessary length, which is not suitable for an electrical hand-held power tool.

According to U.S. Pat. No. 3,681,627, an electrical hand-held power tool which is formed as an ultrasound drilling machine, is configured as a unit that includes a housing and a tool and is formed as an axially resonant vibrating rod oscillator excited by a piezo element, which is powered by a.c. to vibrations at 20 kHz. In this case, the annular piezo element is combined with the tool which, oriented opposite to the piezo element, vibrationally extends through the piezo element. By virtue of the respective alternatingly oriented, coaxial nesting of the housing, the piezo element and the tool, the overall structural length of the electrical hand-held power tool is reduced. In the case of this ultrasound drilling machine that is manually pressed by the user against a workpiece, the ultrasound vibrations of the tip of the tool cause only a sporadic lifting of same from the workpiece. A necessary, high-energy impact force is not triggered by the ultrasound vibration, especially when chiseling brittle materials like concrete or masonry.

According to U.S. Pat. No. 3,683,470, a percussive ultrasound—supported electrical hand-held power tool has an inherently pressure—biased piezo actor as the sole exciting means. An electrical hand-held power tool pressed by the user against a workpiece executes, as the result of excitation of the whole unit, a resonant low—frequency primary vibration of about 50 Hz, which is defined by the mass of An electrical hand-held power tool and the effective spring constant of the hand—arm system of the user. During approximately ⅓ of this primary vibration period, an ultrasound triggering of approximately 10 kHz, which is produced by the piezo actor, is superimposed on the dead center of the movement facing towards the workpiece. The necessary high-energy impact force when chiseling brittle materials like concrete or masonry is not generated by the ultrasound package.

According to EP 1060798, modern precopressed piezo actors are suitable for generation of high-energy axial longitudinal impact sound vibrations and at the same time for use as vibration sensors.

According to DE 19830415 A1, a percussive and rotating pulse striking mechanism for driving a probe through the ground operates with a high-energy piezo element. The piezo element expands when a voltage pulse is applied in fractions of a second by a defined magnitude. This abrupt expansion is used to effect a pulse on an anvil and for accelerating a percussion piston in the rearward direction against a spring biased against the housing. The percussion piston consequently receives a kinetic energy, which is stored in the spring and then is again transmitted to the percussion piston. The percussion piston then effects an impact force on the anvil via the piezo element. This impact force is detected electrically at the piezo element to adaptively trigger the next electrical activation of the piezo element, whereby the pulse striking mechanism is auto-excited. A spring, which is biased towards the rear of the housing and acts on the percussion piston, necessarily leads to strong housing vibrations, which must be subdued in electrical hand-held power tools, especially at the rear handle.

SUMMARY OF THE INVENTION

The object of the invention is to provide an electrical hand-held power tool, which generates high-energy impact forces on the tool without strong housing vibrations at the rear handle.

This object is achieved essentially by an electrical hand-held power tool striking along a strike axis and having a tool in front, and including a striking mechanism with a striking means for generating impact forces on the tool, a housing surrounding the striking mechanism and having a handle grip attached thereto, with the striking means being formed as a high-energy piezo actor connected with a voltage pulse generating unit and fixedly attached to the housing.

The housing, which is connected with the piezo actor and encloses a forward-acting striking mechanism, forms with the piezo actor, which is located in the housing coaxially therewith, a longitudinal wave resonator which is vibrationally coupled to their common rear end and which has a length that is half of a length of a rod resonator.

Advantageously, the handle is affixed to a longitudinal expansion vibration node of the housing, whereby the handle can be arranged so that it is subjected to as low-vibrations as possible in proximity to a vibration center point such as the center of gravity.

Advantageously, the handle is connected to the housing by using damping means optimally dampingly synchronized with the vibration mode, whereby residual vibrations are additionally damped.

Advantageously, the handle is configured as a handle stirrup having a rear handle grip and a side accessory grip, whereby a two-handed guidance of the tool is possible, while making possible a low—vibration construction.

Advantageously the piezo actor is biased along the striking axis in a direction opposite its impact deformation, advantageously with at least two springs having different spring constants along the displacement path. Thereby in an initial deformation zone, the piezo actor must perform only minimal work against the bias, while in an end deformation zone of greater deformation, substantial work must be performed, whereby a critical deformation is prevented.

Advantageously, the vibrationally coupled piezo actor-housing system is matched, by an appropriately constructed optimized housing rigidity, to a predetermined, as precisely as possible, mass distribution of the housing of the electrical hand-held power tool, including the tool chuck, jointly to the first longitudinal natural vibration of the piezo actor, whereby both parts vibrate oriented opposite each other. Thus, the rearward pressure components of the piezo actor, which are produced upon generation of the impact force generated by the piezo actor, is compensated by the tensile components of the housing.

Advantageously, the voltage pulse generating unit has a control input, which is connected to a deformation sensor, advantageously to the piezo actor itself, whereby the point in time of impulse generation can be triggered using the natural vibration of the piezo actor—housing system and, accordingly, a self-excitation of the striking mechanism is possible.

Advantageously, the voltage pulse generating unit has a counter, whereby impulse generation occurs only with a pre-selectable, integer multiple of the natural vibration, whereby the average striking performance can be controlled.

Advantageously, the voltage pulse generating unit has a computer unit with calculable striking control functions dependent on the vibration parameters, such as frequency, phase, damping and amplitude which are detected using the voltage pulse generating unit. Thereby, dependent on a workpiece that is characterized by the detected vibration parameters, an optimum striking control can be achieved, e.g., an automatic shut-off upon detection of imbedded in concrete, reinforcement steel that forms the workpiece.

BRIEF DESCRIPTION OF THE INVENTION

Figure 2:
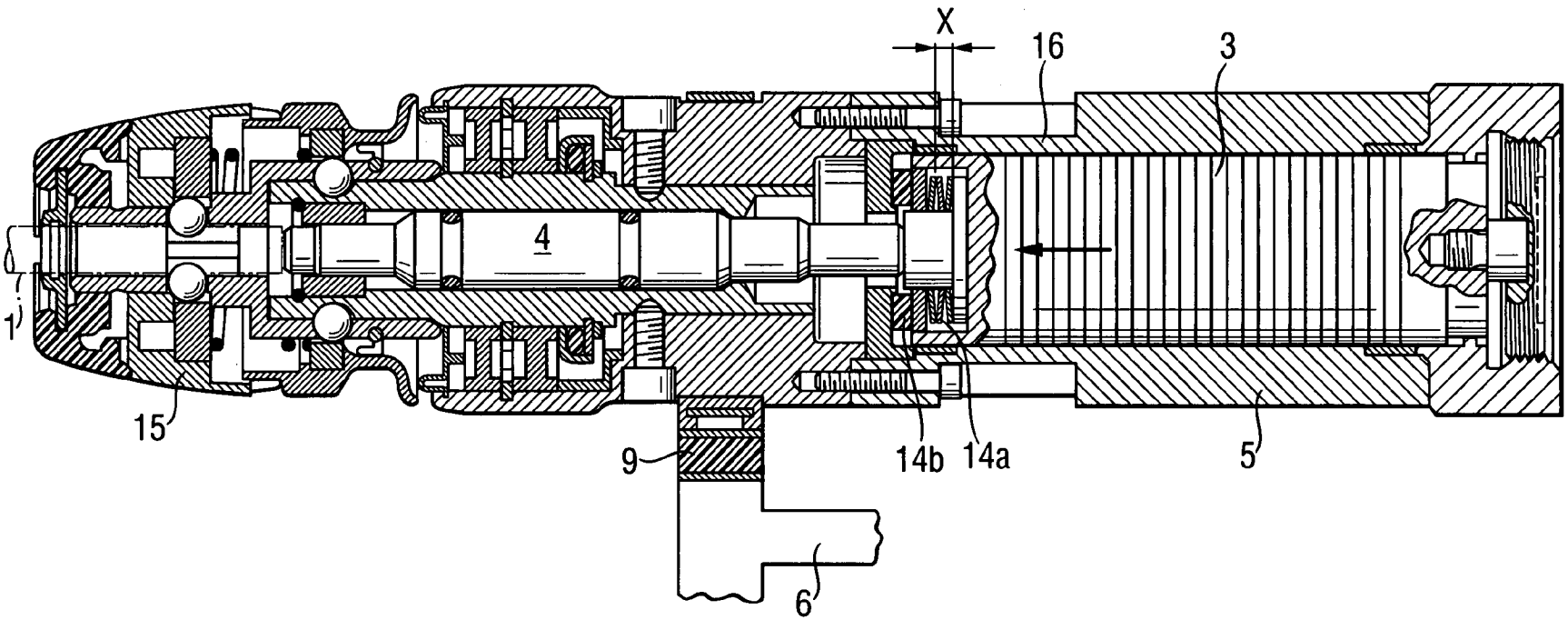

The invention will now be more completely described with reference to the drawings, wherein:

FIG. 1 shows a section of the hand-held power tool according to the invention, and FIG. 2 shows an exemplary embodiment of a chisel hammer according to the invention.

DETAILED DESCRIPTION OF THE PREFERRED EMBODIMENT OF THE INVENTION

According to FIG. 1, an electrical hand-held power tool, which applies blows to a working tool 1 provided in front of the power tool along a striking axis A, has a striking mechanism 2 with the striking means 3, and an anvil 4 that is arranged between the working tool 1 and the striking means 3 and is freely displaceable therebetween. A handle 6 is affixed on a housing 5 in which the striking mechanism 2 is located. The striking mechanism 2 is formed as a high-energy piezo actor connected to voltage pulse-generating unit 7. The piezo actor has its rear side connected with the housing 5 and strikes freely the anvil 4 with its front side. The handle 6, which is formed as a handle stirrup having a rear handle grip 8*a* and a side accessory grip 8*b*, is connected to the housing 5 in the region of the center of gravity S on a longitudinal expansion vibration node of the housing 5. The handle 6 is connected to the housing 5 by a damping element 9 formed as a rubber buffer. The voltage pulse generating unit 7 has a control input 10, which is connected to a deformation sensor 11 for detecting the vibration status at a time t and that is formed by a single piezo disk in the piezo actor itself. In addition, the voltage pulse generating unit 7 has a counter 12 for counting the number of vibrations n of the detected natural vibrations, and a computer unit 13 with striking control functions for the voltage pulse U=U(t, n f, ϕ, d, A) and which depend from the vibration parameters such as frequency f, phase ϕ, damping d, and amplitude A which are detected using the deformation sensor 11 and the voltage pulse generating unit 7.

Since in the nurtured model case of a damped forced vibration, the amplitude A and the phase ϕ are greatly changed with a deviation from the resonance condition, a secondary regulation of the momentary frequency f from these two parameters in the direction of a resonance is possible in the usual fashion. The damping determined upon such a detuned resonance is, under optimal energy input, maximally transmitted, via the working tool, to the workpiece. Thereby, the measurement criterion for the substrate, for example strongly damping for concrete or minimally damping for steel reinforcement in the concrete, and a control parameter for the blow force can deviate. Thus, the measurement criterion and the control parameter significantly reduce the blow force, for example, upon striking steel reinforcement in concrete.

According to FIG. 2, in the case of a chisel hammer, the piezo actor is biased along a deformation path X by using two spring elements 14*a*, 14*b* having different spring constants. The spring elements 14*a*, 14*b* are formed, respectively, as a Belleville spring and a more rigid hard rubber ring which are preloaded along the striking axis A in a direction opposite their impact deformation. The vibration—coupled piezo actor-housing system, including the tool chuck 15, is synchronized by virtue of a constructively optimized housing rigidity using expansion zones 16, with the first longitudinal natural vibration of the piezo actor.

What is claimed is:

1. An electrical hand-held power tool for at least partially percussive driving of a tool (1) along a striking axis (A), comprising a striking mechanism (2) having striking means (3) for generating impact forces on the anterior arranged tool (1), and a housing (5) enclosing the striking mechanism (2) and having a handle (6) affixed thereon, wherein the striking means (3) is formed as a high-energy piezo actor connected to a voltage pulse generating unit (7) and is rearwardly fixed to the housing (5), and wherein the voltage pulse generating unit (7) has a control input (10) connected to a deformation sensor (11).

2. An electrical hand-held power tool of claim 1, wherein the handle (6) is affixed to a longitudinal expansion vibration node of the housing (5).

3. An electrical hand-held power tool of claim 2, wherein the handle (6) is connected to the housing (5) a damping means (9) optimally dampingly tuned to the vibration mode.

4. An electrical hand-held power tool of claim 1, wherein the handle (6) is configured as a handle stirrup with a rear main handle grip (8*a*) and a side accessory grip (8*b*).

5. An electrical hand-held power tool of claim 1, wherein a vibration coupled piezo actor—housing system is jointly tuned with the first longitudinal natural vibration of the piezo actor.

6. An electrical hand-held power tool of claim 1, wherein the voltage pulse generating unit (7) has a counter (12) that controls pulse generation.

7. An electrical hand-held power tool of claim 1, wherein the voltage pulse generating unit (7) has a control input (10) that is connected to the piezo actor.

8. An electrical hand-held power tool for at least partially percussive driving of a tool (1) along a striking axis (A), comprising a striking mechanism (2) having striking means (3) for generating impact forces on the anterior arranged tool (1), and a housing (5) enclosing the striking mechanism (2) and having a handle (6) affixed thereon, wherein the striking means (3) is formed as a high-energy piezo actor connected to a voltage pulse generating unit (7) and is rearwardly fixed to the housing (5), wherein the voltage pulse generating unit (7) has a computer unit (13) for controlling calculable striking functions dependent on detected vibration parameters.

9. An electrical hand-held power tool for at least partially percussive driving of a tool (1) along a striking axis (A), comprising a striking mechanism (2) having striking means (3) for generating impact forces on the anterior arranged tool (1), and a housing (5) enclosing the striking mechanism (2) and having a handle (6) affixed thereon, wherein the striking means (3) is formed as a high-energy piezo actor connected to a voltage pulse generating unit (7) and is rearwardly fixed to the housing (5), wherein the piezo actor comprises spring means (14*a*, 14*b*) for biasing itself against its impact deformation along a displacement path (X), and wherein the spring means comprises at least two different springs.

* * * * *